United States Patent [19]

Zaslavsky et al.

[11] Patent Number: 4,987,344

[45] Date of Patent: Jan. 22, 1991

[54] ARC DISCHARGE LAMP WITH INTERNAL STARTER

[75] Inventors: Gregory Zaslavsky, Chestnut Hill, Mass.; Nikolaos Barakitis, San Jose, Costa Rica

[73] Assignee: GTE Products Corporation, Danvers, Mass.

[21] Appl. No.: 474,962

[22] Filed: Feb. 5, 1990

[51] Int. Cl.[5] ..... H05B 41/14

[52] U.S. Cl. ..... 315/59; 315/60; 315/150; 315/289

[58] Field of Search ..... 315/59, 60, 73, 150, 315/248, 289

[56] References Cited

U.S. PATENT DOCUMENTS

| | | |
|---|---|---|
| 4,647,819 | 3/1987 | Wyner et al. . |
| 4,721,888 | 1/1988 | Proud et al. . |
| 4,808,888 | 2/1989 | Wyner et al. . |
| 4,812,714 | 3/1989 | Keeffe et al. . |
| 4,818,915 | 4/1989 | Zaslavsky et al. . |
| 4,897,576 | 1/1990 | Iida et al. ..... 315/73 |

FOREIGN PATENT DOCUMENTS 3330266 2/1984 Fed. Rep. of Germany .

*Primary Examiner*—Robert J. Pascal

*Attorney, Agent, or Firm*—Carlo S. Bessone

[57] ABSTRACT

A high intensity discharge lamp (e.g., a metal halide) containing an arc tube having first and second electrodes respectively sealed at opposite ends thereof. An outer envelope surrounds the arc tube and has a lamp base disposed at one end thereof. The lamp base has first and second terminals for electrical connection to the arc tube. The lamp further includes means for electrically coupling each of the base terminals to a respective electrode of the arc tube. A starting circuit is disposed within the lamp electrically connected in parallel with the arc tube. The starting circuit comprises a non-linear dielectric element (e.g., a non-linear capacitor) and a glow capsule. The glow capsule is located within the outer envelope proximate the arc tube and adapted to produce ultraviolet radiation.

5 Claims, 3 Drawing Sheets

ARC DISCHARGE LAMP WITH INTERNAL STARTER

TECHNICAL FIELD

This invention relates to the starting of high intensity discharge (HID) lamps and is especially useful with high pressure discharge lamps having a metallic halide fill.

BACKGROUND OF THE INVENTION

High intensity discharge lamps generally comprise an elongated arc tube containing an ionizable fill and having press seals at each end of the tube. Disposed within the arc tube are two main electrodes, one at each end. The electrodes are generally supported in the press seals and are usually connected to a thin molybdenum ribbon, disposed within the press seal. The thin ribbon prevents seal failures because of thermal expansion of the lead-in wire.

In order to facilitate starting of the gaseous discharge, an auxiliary starting electrode disposed in the arc tube adjacent one of the main electrodes has been used in the past. Such an electrode is used because an arc can be ignited between the starter electrode and its adjacent electrode at a much lower starting voltage than is required to ignite a discharge between the two main electrodes. Once the discharge is ignited, the ionizing gas provides primary electrons between the two main electrodes and if enough potential is available between the main electrodes a discharge will be formed therebetween. The starter electrode normally has a resistor in series with it to limit the current flowing through the auxiliary starting electrode after the discharge has started.

Unfortunately, the press sealed electrical feedthrough for the auxiliary starting electrode suffers a sodium electrolysis failure mechanism which may lead to premature seal failures. This mechanism is made worse at the elevated seal temperatures associated with the newer, low color temperature, high efficiency metal halide lamps. For these reasons, the starter electrode approach has generally been abandoned in favor of a high voltage starting pulse applied directly to the main electrodes of the arc tube. With this method, the seal failure problems associated with the starting electrode have been overcome, however, there is often delays from the time the high voltage is applied to the lamp electrodes to the time when the discharge occurs.

Metal halide lamps, on the whole, require higher voltages for reliable starting and operating than do high pressure mercury vapor lamps of corresponding size or rating. Conventional lead-lag ballasts for high pressure mercury vapor lamps do not deliver sufficient voltage for reliable starting As a result, circuits have been developed to further increase the voltage output delivered by a conventional lead-lag ballast during starting.

U.S. Pat. No. 4,808,888, which issued to Wyner et al on Feb. 28, 1989 and is assigned to the Assignee of the present Application, relates to a starting and operating circuit for high pressure discharge lamps. Although the circuit is effective with various high pressure discharge lamps, the circuit does not deliver sufficient voltage to reliably start metal halide lamps. Moreover, it has been found that the circuit produces a starting delay of from 2.0 to 3.0 minutes.

U.S. Pat. No. 4,721,888, which issued to Proud et al on Jan. 26, 1988, relates to an apparatus for starting and operating an arc discharge lamp which contains an ultraviolet enhancer. The ultraviolet enhancer illuminates the path between the electrodes of the arc tube so as to significantly decrease the starting time of the lamp. In the embodiment illustrated in FIGS. 1 and 2, the lamp requires an auxiliary starting electrode 3 and requires three resistors R11, R12, R14 and a diode. FIGS. 3 and 4 of the Proud et al patent illustrate embodiments of an arc discharge lamp without an auxiliary starting electrode. However, these latter embodiments include a spiral line generator 112 which may be relatively bulky.

U.S. Pat. Nos. 4,812,714 and 4,818,915, which issued respectively to Keeffe et al on Mar. 14, 1989 and Zaslavsky et al on Apr. 4, 1989 and are assigned to the same Assignee as the present Application, relate to metal halide arc discharge lamps which contain a source of ultraviolet radiation proximate the arc tube. The lamps described in these two patents operate in conjunction with an externally mounted ignitor 67 (FIG. 4) which is relatively expensive.

BRIEF SUMMARY OF THE INVENTION

It is, therefore, an object of the present invention to obviate the disadvantages of the above cited patents.

It is still another object of the invention to provide a circuit which will reliably start and operate a metal halide discharge lamp.

It is another object of the invention to provide an improved high intensity discharge lamp which does not require an auxiliary starting electrode.

It is still another object of the invention to provide a starting and operating circuit for a high intensity discharge lamp which does not require a spiral line generator or an external ignitor.

These objects are accomplished in one aspect of the invention by the provision of a high intensity discharge lamp (e.g., metal halide) containing an arc tube having first and second electrodes respectively sealed at opposite ends thereof. An outer envelope surrounds the arc tube. A lamp base having first and second terminals for electrical connection to the arc tube is disposed at one end of the outer envelope. The lamp further includes means for electrically coupling each of the base terminals to a respective electrode of the arc tube. A starting circuit is disposed within the lamp electrically connected in parallel with the arc tube. The starting circuit comprises a non-linear dielectric element and a UV capsule. The spark gap switch is located within the outer envelope proximate the arc tube and adapted to produce ultraviolet radiation.

In accordance with further teachings of the present invention, the non-linear dielectric element, which may consist of a non-linear capacitor, is disposed within the lamp base.

BRIEF DESCRIPTION OF THE DRAWINGS

The invention will become more readily apparent from the following exemplary description in connection with the accompanying drawings, wherein.

BEST MODE FOR CARRYING OUT THE INVENTION

For a better understanding of the present invention, together with other and further objects, advantages and capabilities thereof, reference is made to the following disclosure and appended claims in connection with the above-described drawings.

Figure 1:
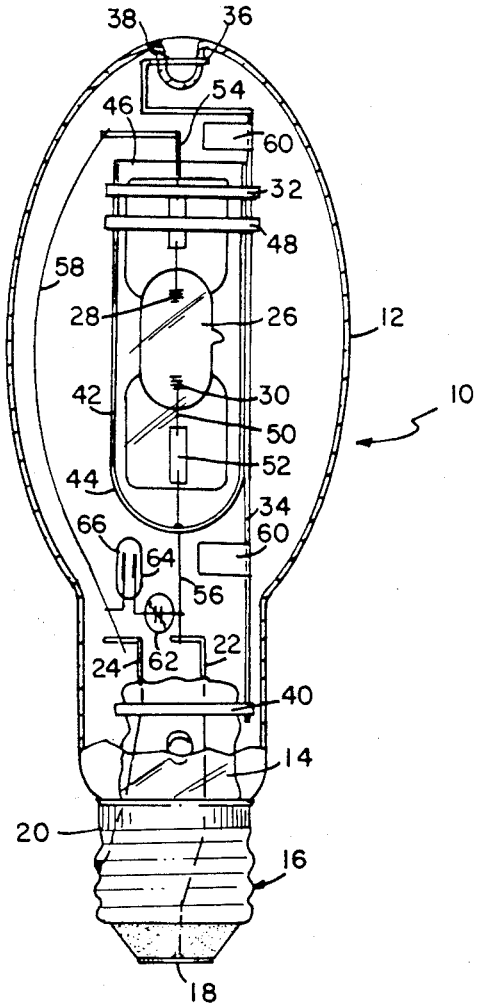
FIG. 1 represents a front elevational view, partially broken away, of one embodiment of a metal halide arc discharge lamp containing the starting circuit according to the present invention.

Referring to the drawings, FIG. 1 illustrates a high intensity discharge lamp 10, such as, a high pressure sodium lamp or a metal halide lamp having a lamp wattage of from 75 to 150 watts. Lamp 10 includes an evacuated outer envelope or jacket 12. hermetically sealed to a glass stem member 14. An external base 16, having first and second terminals 18 and 20, respectively, is affixed to the hermetically sealed stem member 14 and evacuated outer envelope 12 for connection to an electrical circuit. A pair of stem lead electrical conductors 22 and 24 are sealed into and pass through stem member 14 and are electrically connected to the terminals of base 16 external of evacuated outer envelope 12 to provide access for energization of the discharge lamp 10.

Disposed within outer envelope 12 is an arc tube 26 having an ionizable radiation-generating chemical fill which may include mercury and metal halides which reach pressures of several atmospheres at normal operating temperatures from 600° to 800° C. One suitable fill comprises mercury, sodium iodide, scandium iodide, and an inert gas such as argon to facilitate starting and warm-up. The fill may include iodides of sodium and scandium of a ratio in the range about 20:1 to 28:1. Arc tube 26 also includes first and second electrodes 28 and 30, respectively sealed at opposite ends thereof. A metal outer strap member 32 is affixed to the outer surface of arc tube 26. Strap member 32 is electrically coupled to and mechanically connected to a support member 34.

Support member 34 extends along an axis parallel to the longitudinal axis of the discharge lamp 10 and includes at one end an annular configuration 36 adjacent and in register with an upper portion 38 of evacuated envelope 12. The other end of support member 34 is securely held by a strap member 40 which extends around stem member 14.

A heat loss reducing member 42 in the form of a quartz sleeve surrounds arc tube 26. Heat loss reducing member 42 may include a domed portion 44 positioned closest to base 16 and an open-ended portion 46 which is furthest from and faces away from base 16. A metal band 48 surrounds and is affixed to heat loss reducing member 42 and is electrically and mechanically connected to the support member 34.

Electrodes 28, 30 are mounted at opposite ends of arc tube 26, each including a shank portion 50 which extends to a molybdenum foil 52 to which an outer conductor lead 54, 56 is connected. The hermetic seals are made at the molybdenum foils upon which the fused silica of the pinches are pressed during the pinch sealing operation. Arc tube conductor lead 56 is connected to electrical conductor 22. Arc tube lead 54 is connected to a return lead 58, that is disposed adjacent heat loss reducing member 42, which is connected to conductor stem lead 24. Electrical conductors 22, 24 are respectively connected to terminals 18, 20 on screw base 16 attached to the neck end of envelope 12 thereby completing the lamp operating circuit. Upper and lower getters 60 are positioned within outer envelope 12 and attached to support member 34.

As shown in FIG. 1, high intensity discharge lamp 10 further includes a starting circuit disposed within the lamp. The starting circuit includes a non-linear dielectric element 62 and a UV capsule 64 serially connected. One end of non-linear dielectric element 62 is electrically connected to outer conductor lead 56. One end of UV capsule 64 is electrically connected to return lead 58 so that the starting circuit is electrically connected in parallel with arc tube 26. UV capsule 64 is located within outer envelope 12 proximate arc tube 26.

UV capsule 64 includes an envelope 66 of ultraviolet light transmitting material such as pure fused silica (quartz), Vycor brand of high-silica glass (Corning Glass Works) or borosilicate. A pair of electrodes is enclosed within envelope 66 by means of a seal (e.g., a pinch seal) formed at one end (as shown) or at opposite ends of the envelope. A fill material including an inert gas or combinations thereof at a pressure within the range of from about 15 to 30 torr and a quantity of mercury is contained within envelope 66. Both the intensity of the ultraviolet light generated and the breakdown voltage of the source increase as the fill pressure within the source is increased. The time between the point when the voltage is applied to the lamp electrodes and the point when gas breakdown occurs, increases as the fill pressure is increased.

Non-linear dielectric element 62 may comprise at least one non-linear capacitor (NLC) which consists essentially of barium titanate ($BaTiO_3$). When placed in the outer jacket 12, the entire outer surface of the NLC is encapsulated with glass material, which can consist of a glass with a low melting point or of a glass with a high dielectric constant. The encapsulation prevents an impairment of the breakdown voltage characteristics of the NLC due to the high operating temperature.

Figure 2:
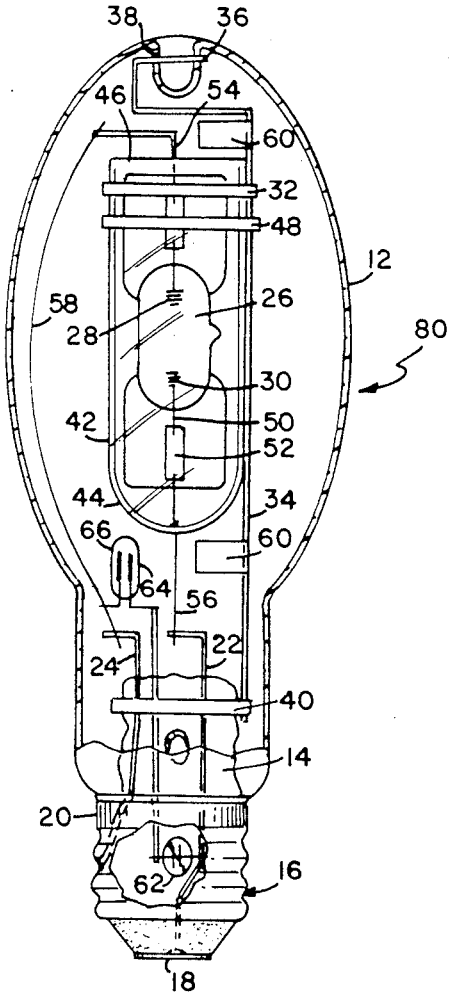
FIG. 2 is a front elevational view, partially broken away, of another embodiment of the present invention.

Referring next to FIG. 2, there is shown a high intensity discharge lamp 80 according to another embodiment of the present invention, wherein substantially the same constituent members as those in FIG. 1 are denoted by the same reference numerals. A third electrical conductor 70 is sealed into and passes through stem member 14. In the embodiment illustrated in FIG. 2, one lead of UV capsule 64 is electrically connected to return lead 58. The other lead of UV capsule 64 is connected to one end of electrical conductor 7 located within outer jacket 12. Non-linear dielectric element 62 is disposed external to outer jacket 12 and stem 9 within external base 16. One end of element 62 is connected to the other end of electrical conductor 70 while the other end of element 62 is connected to electrical conductor 22. As such, the starting circuit is electrically connected in parallel with arc tube 26. Locating the NLC within the lamp base eliminates the need for glass encapsulation of the device.

Figure 3:
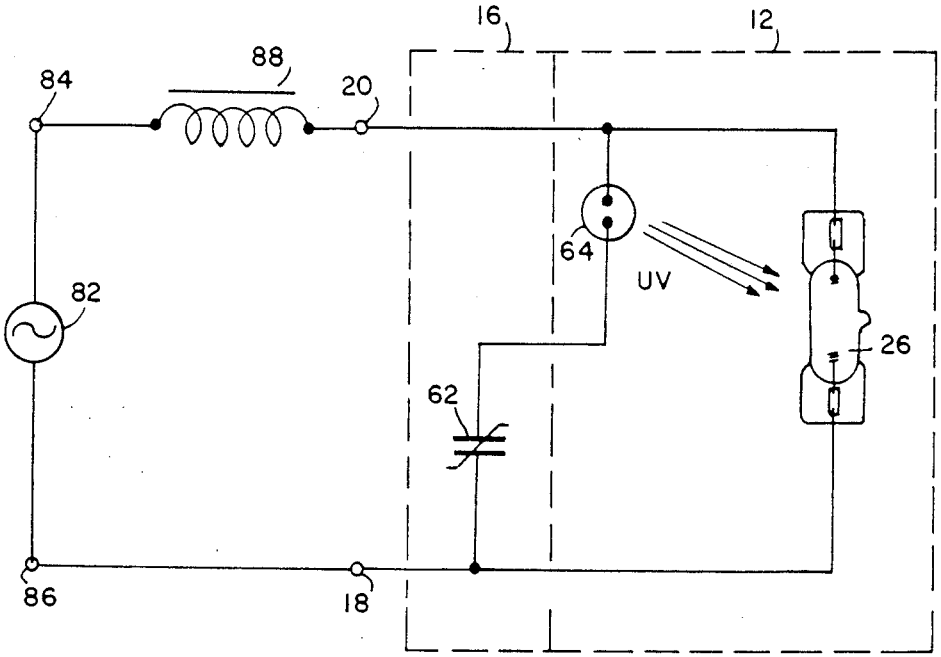
FIG. 3 is a schematic diagram of an embodiment of the invention.

FIG. 3 is a schematic diagram of an embodiment of the invention. As illustrated therein, an a.c. voltage source 82 is applied to circuit input terminals 84, 86. An inductive ballast 88 is connected between circuit input terminal 84 and one of the lamp terminals 20. The lamp is illustrated as including a UV-emitting glow capsule 64 disposed within outer jacket 12 and an NLC 62 located within base 16 of the lamp.

In operation, the UV capsule becomes conductive when the amplitude of the input voltage source reaches the breakdown voltage of the UV capsule. Conduction of the UV capsule causes the NLC to produce a high voltage pulse of from 1.0 to 2.0 KV across the arc tube. Moreover, conduction of the spark gap switch produces ultraviolet radiation which illuminates the path between the main electrodes of the arc tube and thereby increases the probability of generating the discharge. The pulse voltage required to start the discharge is significantly reduced by the introduction of the UV-emitting glow capsule. The average time needed to produce a discharge within the arc tube is from 0.1 to 0.2 second. After arc tube ignition, the starting circuit becomes disabled because the voltage across the arc tube (and across the starting circuit) is significantly lower than the breakdown voltage of the UV capsule.

In a typical but non-limitative example of a high intensity discharge lamp in accordance with the teachings of the present invention, the lamp is a 100 watt M90 metal halide lamp containing a UV-emitting glow capsule and a single non-linear capacitor. The envelope of the spark gap switch is formed from 9741 borosilicate glass available from Corning Glass Works having an outside diameter of 0.295 inch (7.5 millimeters) and a wall thickness of 0.0295 inch (0.75 millimeter). The spark gap envelope contains an argon fill at a pressure of approximately 20 torr. A pair of electrodes is formed by attaching a 0.080 inch (2.0 millimeters) by 0.250 inch (6.35 millimeters) piece of getter material to a Rodar rod which extends through a pinch seal located at one end of the envelope. One suitable material for the getter material is ST101/ST505 manufactured by SAES Getters S.p.A., Milan, Italy. This particular material can serve as both a gettering material and a mercury dispenser. Another suitable material is a nickel strip having a getter pellet with a Ba—Mg—Th composition.

While there have been shown and described what are at present considered to be the preferred embodiments of the invention, it will be apparent to those skilled in the art that various changes and modifications can be made herein without departing from the scope of the invention. The embodiments shown in the drawings and described in the specification are intended to best explain the principles of the invention and its practical application to hereby enable others in the art to best utilize the invention in various embodiments and with various modifications as are suited to the particular use contemplated.

What is claimed is:

1. A high intensity discharge lamp comprising:

an arc tube having first and second electrodes respectively sealed at opposite ends thereof;

an outer envelope surrounding said arc tube, a lamp base having first and second terminals disposed at one end of said outer envelope;

means for electrically coupling said first terminal of said lamp base to said first electrode of said arc tube;

means for electrically coupling said second terminal of said lamp base to said second electrode of said arc tube; and a starting circuit disposed within said lamp electrically connected in parallel with said arc tube, said starting circuit comprising a non-linear dielectric element and a UV capsule, said UV capsule located within said outer envelope proximate said arc tube and adapted to produce ultraviolet radiation.

2. The high intensity discharge lamp of claim 1 wherein said non-linear dielectric element is disposed within said lamp base.

3. The high intensity discharge lamp of claim 1 wherein said non-linear dielectric element is a non-linear capacitor.

4. The high intensity discharge lamp of claim 1 wherein said lamp is a metal halide lamp.

5. The high intensity discharge lamp of claim 4 wherein said arc tube contains a chemical fill including mercury and metal halides.

* * * * *